US011326309B2

(12) United States Patent
Shigyo

(10) Patent No.: US 11,326,309 B2
(45) Date of Patent: May 10, 2022

(54) PAPER TREATMENT AGENT

(71) Applicant: MIYOSHI OIL & FAT CO., LTD., Tokyo (JP)

(72) Inventor: Emi Shigyo, Aichi (JP)

(73) Assignee: MIYOSHI OIL & FAT CO., LTD., Tokyo (JP)

( * ) Notice: Subject to any disclaimer, the term of this patent is extended or adjusted under 35 U.S.C. 154(b) by 140 days.

(21) Appl. No.: 16/978,863

(22) PCT Filed: Mar. 5, 2019

(86) PCT No.: PCT/JP2019/008578
§ 371 (c)(1),
(2) Date: Sep. 8, 2020

(87) PCT Pub. No.: WO2019/176644
PCT Pub. Date: Sep. 19, 2019

(65) Prior Publication Data

US 2021/0047783 A1 Feb. 18, 2021

(30) Foreign Application Priority Data

Mar. 14, 2018 (JP) ..... JP2018-046528

(51) Int. Cl.

| | |
|---|---|
| ***D21H 17/10*** | (2006.01) |
| ***D21H 21/24*** | (2006.01) |
| ***D21H 17/06*** | (2006.01) |
| ***D21H 17/07*** | (2006.01) |
| ***D21H 17/09*** | (2006.01) |
| ***D21H 17/14*** | (2006.01) |
| ***D21H 17/00*** | (2006.01) |
| ***D21H 23/22*** | (2006.01) |
| *A47K 10/16* | (2006.01) |

(52) U.S. Cl.
CPC ..... *D21H 21/24* (2013.01); *D21H 17/06* (2013.01); *D21H 17/07* (2013.01); *D21H 17/09* (2013.01); *D21H 17/10* (2013.01); *D21H 17/14* (2013.01); *D21H 17/72* (2013.01); *D21H 23/22* (2013.01); *A47K 10/16* (2013.01)

(58) Field of Classification Search
USPC ..... 162/179
See application file for complete search history.

(56) References Cited

U.S. PATENT DOCUMENTS 11,242,655 B2 * 2/2022 Shigyo ..... A61K 8/463

FOREIGN PATENT DOCUMENTS

| | | |
|---|---|---|
| JP | 9-105075 | 4/1997 |
| JP | 10-226986 | 8/1998 |
| JP | 2007-107173 | 4/2007 |
| JP | 2008-7926 | 1/2008 |
| JP | 2011-111703 | 6/2011 |
| JP | 2013-189725 | 9/2013 |
| JP | 2014-503441 | 2/2014 |
| JP | 2014-65986 | 4/2014 |
| JP | 2014-208921 | 11/2014 |
| JP | 2015-203172 | 11/2015 |
| JP | 2016-74999 | 5/2016 |
| JP | 2017-106131 | 6/2017 |

OTHER PUBLICATIONS

International Search Report (ISR) dated May 21, 2019 in corresponding International (PCT) Application No. PCT/JP2019/008578.

* cited by examiner

*Primary Examiner* — Mark Halpern
(74) *Attorney, Agent, or Firm* — Wenderoth, Lind & Ponack, L.L.P.

(57) ABSTRACT

Provided is a paper treatment agent with which improved touch feeling different from smoothness that has been conventionally studied is obtainable when a pressure is applied like nose blowing or the like. A paper treatment agent of the present invention is a paper treatment agent containing (A) a polyhydric alcohol as a main component, the paper treatment agent contains (B) a sucrose fatty acid ester having an acyl group with more than 12 and less than 22 carbon atoms and an HLB of 11 or more and (C) an ionic surfactant, and it is characterized in that a mass ratio (C/B) of the component (C) to the component (B) is 0.65 to 24. According to the paper treatment agent of the present invention, when a pressure is applied to treated paper like nose blowing or the like, slick texture that is specific and distinctive smoothness which is non-conventional is obtainable.

6 Claims, No Drawings

PAPER TREATMENT AGENT

This application is a 371 of PCT/JP2019/008578 filed 5 Mar. 2019

TECHNICAL FIELD

The present invention relates to a paper treatment agent.

BACKGROUND ART

Conventionally, paper products to which moist texture and softness are imparted as compared to usual dry tissues and the like by treating paper with a paper treatment agent containing a moisturizing agent as a main component, are known. Lotion tissues that are representative products thereof are moisture tissues obtained by applying a lotion as a paper treatment agent to tissue base paper, and since the lotion tissues have moist and soft texture and greatly improves usability, the lotion tissues have been widely used as seasonal products during the winter season such as countermeasures for pollen disease and influenza, have been widespread to ordinary use applications from use applications mainly for nose blowing in recent years, and have been used through a whole year.

In the moisturizing agent of the moisture tissue, a polyhydric alcohol such as glycerin or polyethylene glycol (PEG), particularly, glycerin that is an inexpensive, safe, and excellent moisturizing agent is used in many cases. This moisturizing agent enhances moisture-absorption property and moisture-retaining property of paper and imparts moist and soft texture to paper.

Texture as feeling of materials or touch feeling which a person feels when touching an object has a significant effect on usability of the moisture tissue, and becomes one of the most important quality that becomes an added value of the product. As texture of the moisture tissue, smoothness has been conventionally studied along with moist texture and softness. Smoothness that has been conventionally studied has been evaluated as sensuality in the broad sense of the term that is slightly rough or slippery without particular distinction between touch feeling in a case where the moisture tissue is touched as being lightly traced and touch feeling in a case where the moisture tissue is slightly strongly pressed in nose blowing or the like, and smoothness has been considered as one of indexes indicating favorable texture.

However, texture when the moisture tissue is brought into contact with the skin in nose blowing or the like, particularly, feeling of a consumer when the moisture tissue is strongly pressed against the skin in keeping with actual usage is highly sensitized. Therefore, improvement and specific properties of texture that is different from conventional feeling, particularly, that is felt when the tissue is strongly pressed against the skin are recognized as usability different from the conventional case by the consumer as long as the texture is, for example, gentle touch feeling and reduces load to the skin, and these have a significant effect as comfortable touch feeling, and such technical improvement may become added values of the product.

Conventionally, as a technique whose object is to improve texture such as softness and smoothness in addition to moist texture obtained by a moisturizing agent, a technique in which various additive components are blended along with a moisturizing agent in a paper treatment agent containing a moisturizing agent as a main component has been proposed (Patent Literatures 1 to 8).

CITATION LIST

Patent Literature

Patent Literature 1: JP H10-226986 A
Patent Literature 2: JP 2007-107173 A
Patent Literature 3: JP 2008-7926 A
Patent Literature 4: JP 2014-65986 A
Patent Literature 5: JP 2015-203172 A
Patent Literature 6: Journal of technical disclosure 2014-503441
Patent Literature 7: JP 2013-189725 A
Patent Literature 8: JP 2014-208921 A

SUMMARY OF INVENTION

Technical Problem

However, in conventional techniques as described above, a further improvement which is distinctively recognized from texture such as smoothness that has been conventionally evaluated has not been studied. For example, in Patent Literatures 1 to 4, various additive components are blended for the purpose of such smoothness in the broad sense of the term that has been conventionally recognized. In Patent Literature 5, a sucrose fatty acid ester is blended for the purpose of imparting softness, and in Patent Literatures 6 to 8, it has been proposed to blend a sucrose fatty acid ester and an ionic surfactant for the purpose of improving texture; however, the viewpoint of further improvement as described above, particularly, distinctive texture that is specifically exhibited when a pressure is applied in nose blowing or the like which is a typical use application of the moisture tissue, the number of carbon atoms of fatty acid in the sucrose fatty acid ester, and an HLB that is defined as the balance between hydrophobicity and hydrophily, particularly among these, correlation between HLB and a case where an ionic surfactant is further combined also taking into consideration of the mass ratio has not been focused. That is, the detailed structure and characteristics of the sucrose fatty acid ester and correlativeness with specific texture in the case of combination with a specific surfactant have not been specifically studied.

The present invention is made in view of the circumstances described above, and an object thereof is to provide a paper treatment agent with which improved touch feeling different from smoothness that has been conventionally studied is obtainable when a pressure is applied like nose blowing or the like.

Solution to Problem

The present inventors have conducted intensive studies in order to solve the above-described problems, and as a result, have found that, in a case where a sucrose fatty acid ester having a combination of the specific number of carbon atoms of fatty acid and a specific HLB and an ionic surfactant are blended to have a specific mass ratio, for example, when a pressure is applied like the case of slightly strongly pressing treated paper in nose blowing or the like, slick texture that is distinctive smoothness, in other words, slimy smoothness that is felt as there is no catching when the treated paper is slightly strongly pressed is specifically exhibited, thereby completing the present invention.

That is, a paper treatment agent of the present invention is a paper treatment agent containing (A) a polyhydric alcohol as a main component, the paper treatment agent contains (B) a sucrose fatty acid ester having an acyl group with more than 12 and less than 22 carbon atoms and an HLB of 11 or more and (C) an ionic surfactant, and it is characterized in that a mass ratio (C/B) of the component (C) to the component (B) is 0.65 to 24.

A method of the present invention is characterized to improve the slick texture of paper by treating the paper with the above-described paper treatment agent.

Advantageous Effects of Invention

According to the paper treatment agent of the present invention and the method using the paper treatment agent, when a pressure is applied to the treated paper like nose blowing or the like, slick texture that is specific and distinctive smoothness which is non-conventional is obtainable.

DESCRIPTION OF EMBODIMENTS

Hereinafter, the present invention will be described in detail.

In a paper treatment agent of the present invention, a polyhydric alcohol of a component (A) is a moisturizing agent that enhances moisture-absorption property and moisture-retaining property of paper and imparts moist texture to paper, and is a main component of the paper treatment agent.

Herein, the main component means that the component (A) is blended in the most mass in the respective additive components that are raw materials of the paper treatment agent. In particular, the content of the component (A) is preferably 50% by mass or more, more preferably 70% by mass or more, even more preferably 75% by mass, and still even more preferably 80% by mass or more with respect to the total amount of the raw materials of the paper treatment agent excluding water. Incidentally, the blended components of the paper treatment agent are based on the effective content and indicate values excluding water.

Examples of the polyhydric alcohol of the component (A) used in the present invention include glycerin, diglycerin, triglycerin, polyglycerol, 1,2-propanediol, 1,3-propanediol, dipropylene glycol, polypropylene glycol, 1,3-butanediol, 1,4-butanediol, 1,2-pentanediol, 1,2-hexanediol, ethylene glycol, diethylene glycol, triethylene glycol, polyethylene glycol, polyoxyethylene glycerin ether, isoprene glycol, pentaerythritol, and trimethylol propane. Furthermore, the polyhydric alcohol may be sugar alcohols or sugars, and examples of the sugar alcohols include sorbitol, inositol, glucosyl trehalose, xylitol, erythritol, mannitol, lactitol, fructose, oligosaccharide alcohol, maltitol, reduced palatinose, reduced glucose syrup, and reduced starch hydrolysate. Examples of the sugars include fructose, grape sugar, milk sugar, xylose, psicose, malt sugar, glucose syrup, oligosaccharide, maltose, trehalose, lactose, Palatinit, sucrose, isomerized sugar, isomalto-oligosaccharide, fructo-oligosaccharide, galacto-oligosaccharide, xylo-oligosaccharide, lactosucrose, soybean-oligosaccharide, raffinose, stevia, licorice root, saccharin, aspartame, acesulfame K, and sucralose. These may be used singly or in combination of two or more kinds thereof.

Among these, glycerin is preferred. In the case of using glycerin as the moisturizing agent, the ratio of glycerin to the total amount of the moisturizing agent is preferably 80% by mass or more and more preferably 90% by mass or more. As the moisturizing agent used in combination with glycerin, for example, sorbitol or the like is mentioned.

In the paper treatment agent of the present invention, as the moisturizing agent, components other than the polyhydric alcohol of the component (A) may be used in combination with the component (A). Examples of such a moisturizing agent include amino acids, alkalis/acids having moisture-absorption property, and salts thereof. Examples of the amino acids include glycine, valine, leucine, isoleucine, serine, threonine, phenylalanine, arginine, lysine, aspartic acid, glutamic acid, cystine, cysteine, methionine, and tryptophan. Examples of the alkalis/acids having moisture-absorption property, and salts thereof include pantetheine-S-sulfonate, trimethylglycine, betaine, pyrophosphoric acid, sodium pyrophosphate, chondroitin sulfate, potassium pyrophosphate, hyaluronic acid, sodium hyaluronate, sodium metaphosphate, potassium polyphosphate, sodium pyrrolidonecarboxylate, sodium lactate, sodium chloride, calcium chloride, sodium alginate, and sodium polyacrylate. These may be used singly or in combination of two or more kinds thereof.

In the paper treatment agent of the present invention, the component (B) is a sucrose fatty acid ester having an acyl group with more than 12 and less than 22 carbon atoms and an HLB of 11 or more (hereinafter, abbreviated as "sucrose fatty acid ester" in some cases). By using the component (B) in combination with the ionic surfactant of the component (C) so that mass ratio (C/B) becomes 0.65 to 24, when a pressure is applied to the treated paper like nose blowing or the like, slick texture that is distinctive smoothness is obtainable.

Examples of a constituent fatty acid of the sucrose fatty acid ester used in the present invention include myristic acid, palmitic acid, stearic acid, isostearic acid, oleic acid, linoleic acid, linolenic, and arachidic acid. Furthermore, an acyl group derived from a mixed fatty acid such as lard or palm oil fatty acid may be used. The fatty acid may be linear or branched and may be any of a saturated fatty acid and an unsaturated fatty acid; however, a linear fatty acid is preferred and a saturated fatty acid is preferred. The lower limit of the number of carbon atoms of the acyl group of the sucrose fatty acid ester is more than 12 and may be 14 or more or 16 or more. Furthermore, the upper limit of the number of carbon atoms is less than 22 and may be 20 or less or 18 or less. It is sufficient that the sucrose fatty acid ester in the present invention has these fatty acids as main constituent fatty acids.

Examples of the sucrose fatty acid ester include sucrose myristic acid ester, sucrose palmitic acid ester, sucrose stearic acid ester, sucrose arachidic acid ester, and sucrose oleic acid ester, and sucrose myristic acid ester, sucrose palmitic acid ester, and sucrose stearic acid ester are preferred. These may be used singly or in combination of two or more kinds thereof.

The HLB of the sucrose fatty acid ester is preferably 11 to 19 and more preferably 11 to 16.

The HLB is a numerical value representing the balance between hydrophobicity and hydrophily of an emulsifier, and as the HLB of the sucrose fatty acid ester, a value obtained by the method using emulsification experiment is referred to. In the case of using commercially available products, values described in catalogs thereof and the like are also referred to. The range of the HLB of the sucrose fatty acid ester is 1 to 19, and the sucrose fatty acid ester is known as an emulsifier having a wide HLB range.

As for the sucrose fatty acid ester, the content of mono-, di-, and triesters is not particularly limited, and the content of the monoester is preferably 50% or more and more preferably 55% or more. Furthermore, the content thereof is preferably 95% or less and more preferably 75% or less.

Examples of commercially available products of the sucrose fatty acid ester include RYOTO Sugar Esters M-1695 (sucrose myristic acid ester, HLB 16), P-1570 (sucrose palmitic acid ester, HLB 15), P-1670 (sucrose palmitic acid ester, HLB 16), S-1170 (sucrose stearic acid ester, HLB 11), S-1570 (sucrose stearic acid ester, HLB 15), S-1670 (sucrose stearic acid ester, HLB 16), and O-1570 (sucrose oleic acid ester, HLB 15) manufactured by Mitsubishi-Chemical Foods Corporation, and DK Esters F-110 (sucrose stearic acid ester, HLB 11), F-140 (sucrose stearic acid ester, HLB 13), F-160 (sucrose stearic acid ester, HLB 15), and SS (sucrose stearic acid ester, HLB 19) manufactured by DKS Co. Ltd.

The content of the component (B) in the paper treatment agent of the present invention is preferably 0.01% by mass or more, more preferably 0.1% by mass or more, and even more preferably 0.2% by mass or more with respect to the total amount of the treatment agent excluding water, taking into consideration of distinctive texture when the paper is strongly pressed against the skin. Furthermore, taking into consideration the fact that uniform coating properties of the paper treatment agent to the paper which are involved in the texture of the paper, the content thereof is preferably 5% by mass or less, more preferably 3% by mass or less, and even more preferably 2% by mass or less with respect to the total amount of the treatment agent excluding water.

In the paper treatment agent of the present invention, the ionic surfactant of the component (C) is not particularly limited, and an anionic surfactant, a cationic surfactant, and an ampholytic surfactant can be used.

The anionic surfactant is not particularly limited, and anionic surfactants of phosphate type, sulfonate type, sulfate type, carboxylate type, and the like can be used. These may be used singly or in combination of two or more kinds thereof.

Examples of the anionic surfactant of phosphate type include alkyl phosphate, alkyl aryl ether phosphates, fatty acid amide ether phosphates, and polyoxyalkylene alkyl ether phosphates.

Examples of the anionic surfactant of sulfonate type include alkane sulfonate, α-olefin sulfonate, α-sulfofatty acid methyl ester salt, acyl isethionate, alkyl glycidyl ether sulfonate, alkyl sulfosuccinate, polyoxyalkylene alkyl sulfosuccinate, alkyl benzene sulfonate, alkyl naphthalene sulfonate, N-acyl methyl taurine salt, formalin condensed sulfonate, paraffin sulfonate, alkylamide sulfonate, alkenyl amide sulfonate, alkyl glyceryl ether sulfonate, and alkylarylether sulfonate.

Examples of the anionic surfactant of sulfate type include alkyl sulfate, alkenyl sulfate, alkyl ether sulfate, alkenyl ether sulfate, polyoxyalkylene alkyl ether sulfate, alkylarylether sulfate, fatty acid alkanolamide sulfate, fatty acid monoglyceride sulfate, polyoxyalkylene fatty acid amide ether sulfate, alkyl glyceryl ether sulfate, and sulfated fatty acid alkyl ester.

Examples of the anionic surfactant of carboxylate type include fatty acid soap, alkyl ether carboxylate, alkylene alkyl ether carboxylate, fatty acid amide ether carboxylate, acylated lactate, N-acyl glutamate, N-acyl alanine salt, N-acyl sarcosine salt, N-acyl-ω-amino acid salt, alkyl sulfoacetate, alkenyl sulfoacetate, alkenyl succinate, rosin acid salt, and naphthenate.

The cationic surfactant is not particularly limited, and cationic surfactants of quaternary ammonium salt type, pyridinium salt type, alkylamine salt type, and the like can be used. These may be used singly or in combination of two or more kinds thereof.

Examples of the cationic surfactant of quaternary ammonium salt type include alkyl trimethylammonium salt, dialkyl dimethylammonium salt, alkyl benzalkonium salt, N,N-dialkyloyloxyethyl-N-methyl, and N-hydroxyethyl ammonium salt.

Examples of the cationic surfactant of pyridinium salt type include alkylpyridinium salt.

Examples of the cationic surfactant of alkylamine salt type include monoalkylamine salt, dialkylamine salt, and trialkylamine salt.

The ampholytic surfactant is not particularly limited, and ampholytic surfactants of betaine type, imidazoline type, amino acid type, amine oxide type, and the like can be used. These may be used singly or in combination of two or more kinds thereof.

Examples of the ampholytic surfactant of betaine type include alkylbetaine, fatty acid amidopropyl betaine, lauryl hydroxysulfobetaine, alkyl hydroxysulfobetaine, lecithin, and hydrogenated lecithin.

Examples of the ampholytic surfactant of imidazoline type include 2-alkyl-N-carboxymethyl-N-hydroxyethylimidazolinium betaine, 2-alkyl-1-(2-hydroxyethyl)imidazolinium-1-acetate, and sodium undecyl hydroxyethylimidazolinium betaine.

Examples of the ampholytic surfactant of amino acid type include alkyl diethylenetriaminoacetate, alkyloxyhydroxypropyl arginine hydrochloride, sodium lauryl aminodiacetate, dihydroxyalkyl methylglycine, sodium lauryl diaminoethylglycinate, lauriminodipropionate, N-[3-alkyloxy-2-hydroxypropyl]-L-arginine hydrochloride, and sodium alkylaminodipropionate.

Examples of the ampholytic surfactant of amine oxide type include alkyl dimethylamine oxides. These may be used singly or in combination of two or more kinds thereof.

In the paper treatment agent of the present invention, the mass ratio (C/B) of the component (C) to the component (B) is 0.65 to 24. When the mass ratio is within this range, when a pressure is applied to the treated paper like nose blowing or the like, slick texture that is distinctive smoothness is obtainable. From the viewpoint of degradation of texture over time, the lower limit of the mass ratio (C/B) is preferably 0.70 or more, more preferably 1.0 or more, even more preferably 1.5 or more, and particularly preferably 3.0 or more. Furthermore, from the viewpoint of suppressing a viscosity change over time, the upper limit of the mass ratio (C/B) is preferably 23 or less, more preferably 20 or less, even more preferably 15 or less, particularly preferably 10 or less, and most preferably 7 or less.

The mass ratio (B/A) of the component (B) to the component (A) in the paper treatment agent of the present invention is preferably $0.20\times10^{-2}$ or more and more preferably $0.20\times10^{-2}$ to $2.3\times10^{-2}$, from the viewpoint of further improving slick texture that is distinctive smoothness. Furthermore, a low-viscosity paper treatment agent is easily transported, has good handleability, enables management of the amount of the treatment agent applying to the treated paper to be simple, and makes operation property good. Therefore, although it is required to avoid the degradation of operation property due to an increase in viscosity, from the viewpoint of suppressing excessive thickening, the mass ratio (B/A) is preferably $1.0\times10^{-2}$ or less.

The mass ratio (C/A) of the component (C) to the component (A) in the paper treatment agent of the present invention is preferably 0.01 or more and more preferably 0.01 to 0.24, from the viewpoint of further improving slick texture that is distinctive smoothness. Furthermore, from the viewpoint of suppressing excessive thickening, the mass ratio (C/A) is preferably 0.1 or less.

Taking into consideration the fact that the overall respective effects are exhibited, particularly, distinctive slick texture becomes better, the content of the component (C) in the paper treatment agent of the present invention is preferably 0.1% by mass or more, more preferably 0.25% by mass or more, and even more preferably 1% by mass or more with respect to the total amount of the treatment agent excluding water. Furthermore, taking into consideration the fact that uniform coating properties of the paper treatment agent to the paper which are involved in the texture of the paper, the content thereof is preferably 20% by mass or less, more preferably 15% by mass or less, and even more preferably 10% by mass or less with respect to the total amount of the treatment agent excluding water.

In the paper treatment agent of the present invention, a change rate of an MMD value (100×an MMD value of treated paper treated with the paper treatment agent/an MMD value of treated paper treated with glycerin) as measured at a friction static load of 25 g and at 1 mm/sec. between treated paper treated with the paper treatment agent so that an effective content becomes 18±3% by mass with respect to a mass of a dry tissue having a basis weight of 9 to 10 g/m$^2$ and treated paper treated with glycerin under the same condition is preferably less than 95% and more preferably 90% or less. When the change rate of the MMD value is within this range, the paper treatment agent is suitable for obtaining slick texture that is distinctive smoothness.

In the present invention, components other than the above-described components can be added as raw materials to the paper treatment agent within the range that does not impair the effect of the present invention. Such other components are not particularly limited, and examples thereof include water, a nonionic surfactant, an oily component, a thickener, a fungicide, an antiseptic agent, an antifoaming agent, a perfume, dyes, a pH adjuster, extracts, antioxidant, an anti-inflammatory agent, an inorganic mineral, an inorganic salt, and a water-soluble polymer.

Water may or may not be added, but in the case of adding water, the water is added so that the moisture content in the paper treatment agent becomes preferably 1 to 30% by mass, more preferably 3 to 25% by mass, and even more preferably 5 to 20% by mass.

Examples of the nonionic surfactant include sorbitan fatty acid esters, polyoxyethylene sorbitan fatty acid esters, polyoxyethylene fatty acid esters, polyoxyethylene hydrogenated castor oil, polyoxyethylene castor oil, polyoxyethylene hydrogenated castor oil fatty acid esters, castor oil fatty acid esters, hydrogenated castor oil fatty acid esters, ethylene glycol fatty acid esters, sucrose fatty acid esters, glycerin fatty acid esters, diglycerin fatty acid esters, polyglycerol fatty acid esters, organic acid monoglyceride, polyethylene glycol fatty acid monoethanolamide, propylene glycol fatty acid esters, polyoxyethylene lanolin alcohol ether, polyoxyethylene alkyl ether, lauric acid alkanolamide, polyoxyethylene glycerin fatty acid esters, polyoxyethylene hydrogenated castor oil pyroglutamic acid fatty acid diesters, pyroglutamic acid fatty acid glyceryl, polyoxyethylene glyceryl pyroglutamic acid fatty acid diesters, and polyether-modified silicone.

Examples of the oily component include hydrocarbons such as solid paraffin and liquid paraffin, fats and oils, esters, silicone oils, waxes, and steroids. These may be used singly or in combination of two or more kinds thereof.

The paper treatment agent of the present invention can be produced by uniformly mixing respective raw materials according to the ordinary method, and for example, the paper treatment agent can be obtained by stirring and mixing respective raw materials at a temperature at which the respective raw materials are dissolved.

The paper treatment agent of the present invention may be in a state of being melted, solubilized, emulsified, or dispersed.

By treating paper with the paper treatment agent of the present invention, the texture of paper can be improved. In particular, by treating the paper with the paper treatment agent of the present invention, the slick texture of the treated paper is improved.

Examples of paper include tissue paper, toilet paper, facial tissues, pocket tissues, paper handkerchiefs, and paper towels.

The basis weight of the paper is preferably 1 to 50 g/m$^2$ and more preferably 5 to 20 g/m$^2$. The ply number (the number of sheets of base paper stacked) is preferably 1 to 5 and more preferably 2 or 3.

As the method of treating paper with a paper treatment agent, for example, a method of applying a paper treatment agent to paper, and the like are mentioned. Examples of the method of applying a paper treatment agent to paper include transferring and spraying. Examples of methods of applying a paper treatment agent to paper in these methods include a flexographic printing method, a gravure printing method, a spraying method, and a rotor dampening method. In the flexographic printing method, a flexographic printer that is one kind of relief printing machines is used, and a paper treatment agent is transferred to paper by a roller attached with a rubber, a synthetic resin, or the like having a carved surface. In the gravure printing method, a gravure printer that is one kind of intaglio printing machines is used, and a paper treatment agent is transferred to paper by a roller attached to a metal cylinder having a proofed surface. In the spraying method, a paper treatment agent is sprayed from a nozzle to paper in the form of mist by compressed air. In the rotor dampening method, a paper treatment agent is sprayed to paper in the form of mist by a disk rotating at a high speed.

The amount of the paper treatment agent applied to paper is preferably 1 to 7 g/m$^2$ and more preferably 1.5 to 6 g/m$^2$ in terms of effective content excluding water.

Examples

Hereinafter, the present invention will be described in more detail by means of Examples; however, the present invention is not limited to these Examples.

(1) Preparation of Paper Treatment Agent

Paper treatment agents were prepared by the following procedures.

Respective blended raw materials were charged into a beaker in addition amounts described in Table 1 and Table 2 and stirred and mixed at a temperature at which each raw material was dissolved, and thereby paper treatment agents were prepared. The blending amounts of the respective components shown in Table 1 and Table 2 indicate the effective content excluding water in a case where the net weight includes water, and the content of water is omitted.

(2) Production of Treated Paper

The paper treatment agents obtained by the above-described method were dissolved in water, and thereby treatment liquids having an effective content of 18±3% by mass were prepared. Each treatment liquid was uniformly sprayed onto both surfaces of a dry tissue (ply number: 2, basis weight: 9 to 10 g/m$^2$) and thereby each treated paper of Examples 1 to 11 and Comparative Examples 1 to 12 was produced. Thereafter, the treated paper was dried in air for 3 hours and further left to stand until the moisture content rate in a constant temperature and humidity room (temperature: 25° C., humidity: 40% R.H.) reached equilibrium, and then the treated paper was evaluated.

(3) Evaluation

The following evaluations were performed for each treated paper of Examples 1 to 11 and Comparative Examples 1 to 12 produced above (Tables 1 and 2).

[Slick Texture (MMD Value)]

A roughness friction tester KES-SE (KATO TECH CO., LTD.) was used as a tester, the surfaces of two sheets of sample (one set) were traced with a friction wheel, and an average deviation (MMD) of the friction coefficient was obtained. The change rate of an MMD value (100×an MMD value of treated paper treated with the paper treatment agent/an MMD value of treated paper treated with glycerin) as measured at a friction static load of 25 g and at 1 mm/sec. between treated paper sprayed and applied with the treatment liquid so that an effective content of the treatment agent became 18±3% by mass with respect to the mass of a dry tissue and treated paper sprayed and applied with glycerin under the same condition was obtained and evaluated on the basis of the following criteria.

Evaluation Criteria

◎: The change rate of the MMD value is 90% or less.

○: The change rate of the MMD value is 90% or more and less than 95%.

Δ: The change rate of the MMD value is 95% or more and less than 100%.

x: The change rate of the MMD value is 100% or more.

[Slick Texture (Sensory Evaluation)]

Treated paper sprayed and applied with the treatment liquid so that an effective content of the treatment agent became 18±3% by mass with respect to the mass of a dry tissue was used, and as sensory evaluation, the treated paper was evaluated by ten trained panels on the basis of the following evaluation scores with any scores of 1 to 3, and evaluation was performed on the basis of the following criteria by an average value thereof.

Evaluation Scores

3: There is no catching when the paper is slightly strongly pressed, and slimy smoothness is felt.

2: There is no catching when the paper is slightly strongly pressed, and slightly slimy smoothness is felt.

1: Slimy smoothness is not felt.

Evaluation Criteria

◎: An average score of ten panels is 2.5 or more.

○: An average score of ten panels is 2.0 or more and less than 2.5.

Δ: An average score of ten panels is 1.5 or more and less than 2.0.

x: An average score of ten panels is less than 1.5.

[Softness]

Treated paper sprayed with the treatment liquid so that an effective content of the treatment agent became 18±3% by mass with respect to the mass of a dry tissue was used, and as sensory evaluation, the treated paper was evaluated by ten trained panels on the basis of the following evaluation scores with any scores of 1 to 3, and evaluation was performed on the basis of the following criteria by an average value thereof.

Evaluation Scores

3: Very soft

2: Soft

1: Slightly hard

Evaluation Criteria

○: An average score of ten panels is 2 or more.

x: An average score of ten panels is less than 2.

As shown in Table 3, regarding a difference between slick texture that is "distinctive smoothness" and "smoothness" that is recognized as conventional technical common knowledge, Examples 1 and 8 and Comparative Examples 1 and 8 were evaluated as representative examples.

In Table 3, regarding the MIU value, a roughness friction tester KES-SE (KATO TECH CO., LTD.) was used as a tester, the surfaces of two sheets of treated paper (one set) were traced with a friction wheel, and an average friction coefficient (MIU) was obtained. The MMD value and the change rate of the MMD value were measured by the above-described methods, and "slick texture" of the sensory evaluation was evaluated on the basis of the same criteria as described above. "Smoothness" was evaluated by an average value of ten panels on the basis of the same condition and criteria as those in "Slick texture (sensory evaluation)" described above, except that evaluation scores were set as follows.

[Smoothness]

Evaluation Scores

2: Smoothness is felt.

1: Smoothness is not felt.

Evaluation Criteria

○: An average score of ten panels is 1.5 or more.

x: An average score of ten panels is less than 1.5.

The evaluation results described above are shown in Table 3. Slick texture that is distinctive smoothness indicates slimy smoothness that is felt as there is no catching when the treated paper is slightly strongly pressed. In Table 3, when comparing Example 1 in which slick texture (distinctive smoothness) was felt in the sensory evaluation and Comparative Example 1 in which smoothness was felt but slick texture was not felt, the MIU values that are average values of friction coefficients μ are equal to each other, but there is a large difference in the change rate of the MMD value, which is an average deviation of the friction coefficient, from the glycerin-treated paper. Furthermore, when comparing Example 1 and Comparative Example 8 in which neither smoothness nor slick texture were felt, the MIU value and the change rate of the MMD value are also largely different. Furthermore, when comparing Example 1 and Example 8 in which slick texture was felt, this texture can be more strongly felt in Example 1. When comparing physical property values of both Examples, there is no large difference in the MIU value, but a difference in the change rate of the MMD value can be confirmed.

In general, the treated paper with "smoothness" has been known to have a small MIU value, but it was found that "slick texture" that is distinctive smoothness is specifically felt in treated paper having a tendency that the change rate of the MMD value is constant under specific conditions. Since the MIU value and the MMD value are changed not only by the composition of the treatment agent but also by the applying amount of the treatment agent, the specification of base paper, and the like, it was difficult to define the effect of the treatment agent by comparison of absolute values thereof. However, as a result of studies, it was confirmed that the change rate of the MMD value as measured at a friction static load of 25 g and at 1 mm/sec. between treated paper obtained by spraying and applying about 15 to 30% by mass of treatment agent to a dry tissue and treated paper sprayed and applied only with the same level of the applying amount of glycerin tends to have a high correlation with slick texture that is distinctive smoothness. That is, it became clear that, in a case where the change rate of the MMD value in this condition was less than 95%, "distinctive smoothness" was felt, and in a case where the change rate of the MMD value was 95% or more, "distinctive smoothness" was not felt.

The composition of each of Examples and Comparative Examples and the evaluation result of each item are shown in Tables 1 and 2. The results relating to the difference between the slick texture that is "distinctive smoothness" and "smoothness" described above are shown in Table 3. In each evaluation item of Tables 1 to 3, ◎ and ○ are desirable in terms of problem solution, and ◎ and ○ have a significant difference in exhibiting of effects. As the nonionic surfactant of Comparative Examples 10 and 11, polyoxyalkylene polyhydric alcohol was used, and as the nonionic surfactant of Comparative Example 12, polyoxyethylene alkyl ether was used.

TABLE 1

| | | | | Example | | | | | |
|---|---|---|---|---|---|---|---|---|---|
| | | | | 1 | 2 | 3 | 4 | 5 | 6 |
| Composition | Component (A) | Polyhydric alcohol | Glycerin | 100 | 1000 | 100 | 100 | 100 | 100 |
| | | | Sorbitol | | | | | | |
| | Component (B) | Sucrose fatty acid ester | Sucrose myristic acid ester HLB = 16 | | | | | 1 | |
| | | | Sucrose stearic acid ester HLB = 11 | 1 | 1.55 | 1 | | | 1 |
| | | | Sucrose stearic acid ester HLB = 15 | | | | | | |
| | | | Sucrose stearic acid ester HLB = 16 | | | | 1 | | |
| | Component (B') | | Sucrose behenic acid ester HLB = 11 | | | | | | |
| | | | Sucrose lauric acid ester HLB = 16 | | | | | | |
| | | | Sucrose stearic acid ester HLB = 9 | | | | | | |
| | Component (C) | Ionic surfactant | Phosphate type | 24 | 1 | 10 | 10 | 10 | |
| | | | Sulfonate type | | | | | | 10 |
| | | | Quaternary ammonium salt type | | | | | | |
| | | | Alkylamine salt type | | | | | | |
| | Nonionic surfactant | | Polyoxyalkylene polyhydric alcohol | | | | | | |
| | | | Polyoxyethylene alkyl ether | | | | | | |
| | Liquid paraffin | | | | | | | | |
| | Defoaming agent | | | | | | | | |
| | Hydrogenated polyisobutene | | | | | | | | |
| | Isopropyl myristate | | | | | | | | |
| | Total amount (parts by mass) | | | 125 | 1002.6 | 111 | 111 | 111 | 111 |
| | Content (mass %) of component (A) | | | 80 | 99.7 | 90 | 90 | 90 | 90 |
| | Content (mass %) of component (B) or component (B') | | | 0.80 | 0.15 | 0.90 | 0.90 | 0.90 | 0.90 |
| | Mass ratio C/B or C/B' | | | 24 | 0.65 | 10 | 10 | 10 | 10 |
| | Content (mass %) of component (C) | | | 19 | 0.10 | 9.0 | 9.0 | 9.0 | 9.0 |
| | Mass ratio B/A or B'/A ($\times 10^{-2}$) | | | 1.0 | 0.16 | 1.0 | 1.0 | 1.0 | 1.0 |
| | Mass ratio C/A | | | 0.24 | 0.001 | 0.1 | 0.1 | 0.1 | 0.1 |
| Evaluation | Slick texture (distinctive smoothness) | | | ◎ | ○ | ◎ | ◎ | ◎ | ◎ |
| | Change rate of MMD value | | | | | | | | |
| | With respect to glycerin | | | | | | | | |
| | Slick texture (distinctive smoothness) | | | ◎ | ○ | ◎ | ◎ | ◎ | ◎ |
| | Sensory evaluation | | | | | | | | |
| | Softness evaluation | | | ○ | ○ | ○ | ○ | ○ | ○ |

| | | | | Example | | | | |
|---|---|---|---|---|---|---|---|---|
| | | | | 7 | 8 | 9 | 10 | 11 |
| Composition | Component (A) | Polyhydric alcohol | Glycerin | 100 | 4000 | 44 | | 1000 |
| | | | Sorbitol | | | | 100 | |
| | Component (B) | Sucrose fatty acid ester | Sucrose myristic acid ester HLB = 16 | | | | | |
| | | | Sucrose stearic acid ester HLB = 11 | 1 | 1 | 1 | 1 | 2 |
| | | | Sucrose stearic acid ester HLB = 15 | | | | | |
| | | | Sucrose stearic acid ester HLB = 16 | | | | | |
| | Component (B') | | Sucrose behenic acid ester HLB = 11 | | | | | |
| | | | Sucrose lauric acid ester HLB = 16 | | | | | |
| | | | Sucrose stearic acid ester HLB = 9 | | | | | |
| | Component (C) | Ionic surfactant | Phosphate type | | 10 | 10 | 24 | 10 |
| | | | Sulfonate type | | | | | |
| | | | Quaternary ammonium salt type | | | | | |
| | | | Alkylamine salt type | 10 | | | | |
| | Nonionic surfactant | | Polyoxyalkylene polyhydric alcohol | | | | | |
| | | | Polyoxyethylene alkyl ether | | | | | |
| | Liquid paraffin | | | | | | | |
| | Defoaming agent | | | | | | | |
| | Hydrogenated polyisobutene | | | | | | | |
| | Isopropyl myristate | | | | | | | |
| | Total amount (parts by mass) | | | 111 | 4011 | 55 | 125 | 1012 |
| | Content (mass %) of component (A) | | | 90 | 100 | 80 | 80 | 99 |
| | Content (mass %) of component (B) or component (B') | | | 0.90 | 0.02 | 1.8 | 0.80 | 0.20 |
| | Mass ratio C/B or C/B' | | | 10 | 10 | 10 | 24 | 5 |
| | Content (mass %) of component (C) | | | 9.0 | 0.25 | 18 | 19 | 1.0 |
| | Mass ratio B/A or B'/A ($\times 10^{-2}$) | | | 1.0 | 0.03 | 2.3 | 1.0 | 0.20 |
| | Mass ratio C/A | | | 0.1 | 0.003 | 0.23 | 0.24 | 0.01 |
| Evaluation | Slick texture (distinctive smoothness) | | | ◎ | ○ | ◎ | ○ | ◎ |
| | Change rate of MMD value | | | | | | | |
| | With respect to glycerin | | | | | | | |
| | Slick texture (distinctive smoothness) | | | ◎ | ○ | ◎ | ○ | ◎ |
| | Sensory evaluation | | | | | | | |
| | Softness evaluation | | | ○ | ○ | ○ | ○ | ○ |

TABLE 2

| | | | | Comparative Example | | | | | | |
|---|---|---|---|---|---|---|---|---|---|---|
| | | | | 1 | 2 | 3 | 4 | 5 | 6 | 7 |
| Composition | Component (A) | Polyhydric alcohol | Glycerin | 100 | 100 | 100 | 100 | 100 | 100 | 100 |
| | | | Sorbitol | | | | | | | |
| | Component (B) | Sucrose fatty acid ester | Sucrose myristic acid ester HLB = 16 | | | | | | | |
| | | | Sucrose stearic acid ester HLB = 11 | 1 | 1.57 | | | | | 1 |
| | | | Sucrose stearic acid ester HLB = 15 | | | | | | | |
| | | | Sucrose stearic acid ester HLB = 16 | | | | | | | |
| | Component (B') | | Sucrose behenic acid ester HLB = 11 | | | | | 1 | | |
| | | | Sucrose lauric acid ester HLB = 16 | | | | 1 | | | |
| | | | Sucrose stearic acid ester HLB = 9 | | | 1 | | | | |
| | Component (C) | Ionic surfactant | Phosphate type | 25 | 1 | 10 | 10 | 10 | 10 | |
| | | | Sulfonate type | | | | | | | |
| | | | Quaternary ammonium salt type | | | | | | | |
| | | | Alkylamine salt type | | | | | | | |
| | Nonionic surfactant | | Polyoxyalkylene polyhydric alcohol | | | | | | | |
| | | | Polyoxyethylene alkyl ether | | | | | | | |
| | Liquid paraffin | | | | | | | | | |
| | Defoaming agent | | | | | | | | | |
| | Hydrogenated polyisobutene | | | | | | | | | |
| | Isopropyl myristate | | | | | | | | | |
| | Total amount (parts by mass) | | | 126 | 102.57 | 111 | 111 | 111 | 110 | 101 |
| | Content (mass %) of component (A) | | | 79 | 97 | 90 | 90 | 90 | 91 | 99 |
| | Content (mass %) of component (B) or component (B') | | | 0.79 | 1.5 | 0.90 | 0.90 | 0.90 | 0 | 1.0 |
| | Mass ratio C/B or C/B' | | | 25 | 0.64 | 10 | 10 | 10 | — | 0 |
| | Content (mass %) of component (C) | | | 20 | 1.0 | 9.0 | 9.0 | 9.0 | 9.1 | 0 |
| | Mass ratio B/A or B'/A ($\times 10^{-2}$) | | | 1.0 | 1.6 | 1.0 | 1.0 | 1.0 | 0 | 1.0 |
| | Mass ratio C/A | | | 0.25 | 0.01 | 0.1 | 0.1 | 0.1 | 0.1 | 0 |
| Evaluation | Slick texture (distinctive smoothness) | | | Δ | Δ | Δ | Δ | Δ | X | X |
| | Change rate of MMD value | | | | | | | | | |
| | With respect to glycerin | | | | | | | | | |
| | Slick texture (distinctive smoothness) | | | Δ | Δ | Δ | Δ | Δ | X | X |
| | Sensory evaluation | | | | | | | | | |
| | Softness evaluation | | | ○ | ○ | ○ | ○ | ○ | ○ | ○ |

| | | | | Comparative Example | | | | |
|---|---|---|---|---|---|---|---|---|
| | | | | 8 | 9 | 10 | 11 | 12 |
| Composition | Component (A) | Polyhydric alcohol | Glycerin | 100 | 97.65 | 97.8 | 98.8 | 100 |
| | | | Sorbitol | | | | | |
| | Component (B) | Sucrose fatty acid ester | Sucrose myristic acid ester HLB = 16 | | | | | |
| | | | Sucrose stearic acid ester HLB = 11 | | | | | |
| | | | Sucrose stearic acid ester HLB = 15 | | 0.5 | 1 | | |
| | | | Sucrose stearic acid ester HLB = 16 | | | | | 0.04 |
| | Component (B') | | Sucrose behenic acid ester HLB = 11 | | | | | |
| | | | Sucrose lauric acid ester HLB = 16 | | | | | |
| | | | Sucrose stearic acid ester HLB = 9 | | | | | |
| | Component (C) | Ionic surfactant | Phosphate type | | | | | |
| | | | Sulfonate type | | 0.3 | | | |
| | | | Quaternary ammonium salt type | | | | | 1 |
| | | | Alkylamine salt type | | | | | |
| | Nonionic surfactant | | Polyoxyalkylene polyhydric alcohol | | | 1.2 | 1.2 | |
| | | | Polyoxyethylene alkyl ether | | | | | 1 |
| | Liquid paraffin | | | | | | | 2.5 |
| | Defoaming agent | | | | 0.05 | | | |
| | Hydrogenated polyisobutene | | | | 1 | | | |
| | Isopropyl myristate | | | | 0.5 | | | |
| | Total amount (parts by mass) | | | 100 | 100 | 100 | 100 | 104.54 |
| | Content (mass %) of component (A) | | | 100 | 98 | 98 | 99 | 96 |
| | Content (mass %) of component (B) or component (B') | | | 0 | 0.50 | 1.0 | 0 | 0.04 |
| | Mass ratio C/B or C/B' | | | — | 0.60 | 0 | — | 25 |
| | Content (mass %) of component (C) | | | 0 | 0.30 | 0 | 0 | 1.0 |
| | Mass ratio B/A or B'/A ($\times 10^{-2}$) | | | 0 | 0.51 | 1.0 | 0 | 0.04 |
| | Mass ratio C/A | | | 0 | 0.003 | 0 | 0 | 0.01 |
| Evaluation | Slick texture (distinctive smoothness) | | | X | Δ | X | X | Δ |
| | Change rate of MMD value | | | | | | | |
| | With respect to glycerin | | | | | | | |
| | Slick texture (distinctive smoothness) | | | X | Δ | X | X | Δ |
| | Sensory evaluation | | | | | | | |
| | Softness evaluation | | | X | ○ | ○ | X | ○ |

TABLE 3

| Agent No. | Applying amount (mass %) | Standard condition 25 g, 1 mm/sec MIU value | MMD value | Change rate of MMD value | Sensory evaluation Slick texture (distinctive smoothness) | Smoothness |
|---|---|---|---|---|---|---|
| Comparative Example 8 | 18.1 | 0.21 | 0.008 | 100% | X | X |
| Comparative Example 1 | 18.5 | 0.186 | 0.0077 | 96% | Δ | ○ |
| Example 1 | 18.9 | 0.18 | 0.0066 | 83% | ◎ | ○ |
| Example 8 | 18.5 | 0.184 | 0.0075 | 94% | ○ | ○ |

Examples 1 to 11 correspond to a paper treatment agent containing (A) a polyhydric alcohol as a main component, the paper treatment agent contains (B) a sucrose fatty acid ester having an acyl group with more than 12 and less than 22 carbon atoms and an HLB of 11 or more and (C) an ionic surfactant, and a mass ratio (C/B) of the component (C) to the component (B) is 0.65 to 24. Each treated paper of Examples 1 to 11 has slick texture that is distinctive smoothness, and this is confirmed by the change rate of the MMD and sensory evaluation.

From comparison between Example 11 and Examples 1, 3 to 7, and 9 and comparison between Example 2 and Example 8, when the content (B/A) of the component (B) with respect to the component (A) is $0.20\times10^{-2}$ or more and the content (C/A) of the component (C) with respect to the component (A) is 0.01 or more, slick texture is further improved.

In Comparative Examples 1, 2, 9, and 12, the mass ratio (C/B) of the component (C) to the component (B) is out of the above-described range, in Comparative Example 3, the component (A) and the component (C) were added but the HLB of the sucrose fatty acid ester is out of the above-described range, and in Comparative Examples 4 and 5, the number of carbon atoms of the acyl group of the sucrose fatty acid ester is out of the above-described range. In Comparative Example 6, the component (A) and the component (C) were added but the component (B) was not added, in Comparative Example 7, the component (A) and the component (B) were added but the component (C) was not added, in Comparative Example 8, only the component (A) was added, in Comparative Example 10, the component (A), the component (B), and the nonionic surfactant were added but the component (C) was not added, and in Comparative Example 11, the component (A) and the nonionic surfactant were added but the component (B) and the component (C) were not added. Also from comparison with these Comparative Examples, it is confirmed that, by combining a specific sucrose fatty acid ester and an ionic surfactant at a specific ratio, slick texture that is distinctive smoothness and is not obtained by using each component singly is obtainable.

The invention claimed is:

1. A paper treatment agent containing (A) a polyhydric alcohol as a main component, the paper treatment agent comprising:

(B) a sucrose fatty acid ester having an acyl group with more than 12 and less than 22 carbon atoms and an HLB of 11 or more and (C) an ionic surfactant, wherein a mass ratio (CB) of the component (C) to the component (B) is 0.65 to 24.

2. The paper treatment agent according to claim 1, wherein a content of the component (A) is 80% by mass or more with respect to the total amount excluding water.

3. The paper treatment agent according to claim 1, wherein a mass ratio (B/A) of the component (B) to the component (A) is $0.20\times10^{-2}$ or more.

4. The paper treatment agent according to claim 1, wherein a mass ratio (C/A) of the component (C) to the component (A) is 0.01 or more.

5. The paper treatment agent according to claim 1, wherein a change rate of an MMD value (100×an MMD value of treated paper treated with the paper treatment agent/an MMD value of treated paper treated with glycerin) as measured at a friction static load of 25 g and at 1 mm/sec. between treated paper treated with the paper treatment agent so that an effective content becomes 18±3% by mass with respect to a mass of a dry tissue having a basis weight of 9 to 10 g/m$^2$ and treated paper treated with glycerin under the same condition is less than 95%.

6. A method of improving slick texture of paper by treating the paper with the paper treatment agent according to claim 1.

* * * * *